US006705082B2

(12) United States Patent
Ju

(10) Patent No.: US 6,705,082 B2
(45) Date of Patent: Mar. 16, 2004

(54) HYDRAULIC PRESSURE BOOSTER CYLINDER

(76) Inventor: Jae Seak Ju, 103-2419, Samju Bongwang-Apt., 71-1, Bonghoe-ri, Jilyang-Eup, Kyungsan-Si, Kyungbuk (KR)

( * ) Notice: Subject to any disclaimer, the term of this patent is extended or adjusted under 35 U.S.C. 154(b) by 0 days.

(21) Appl. No.: 10/220,436

(22) PCT Filed: Mar. 5, 2001

(86) PCT No.: PCT/KR01/00335

§ 371 (c)(1),
(2), (4) Date: Sep. 3, 2002

(87) PCT Pub. No.: WO01/69088

PCT Pub. Date: Sep. 20, 2001

(65) Prior Publication Data

US 2003/0019211 A1 Jan. 30, 2003

(30) Foreign Application Priority Data

Mar. 15, 2000 (KR) ..... 2000/13031

(51) Int. Cl.[7] ..... F15B 7/00
(52) U.S. Cl. ..... 60/560; 60/565
(58) Field of Search ..... 60/560, 563, 565, 60/581, 583, 593

(56) References Cited

FOREIGN PATENT DOCUMENTS

| | | |
|---|---|---|
| JP | 6-159303 A | 6/1994 |
| JP | 6-213202 A | 8/1994 |

*Primary Examiner*—Edward K. Look
*Assistant Examiner*—Michael Leslie
(74) *Attorney, Agent, or Firm*—Birch, Stewart, Kolasch & Birch, LLP

(57) ABSTRACT

Disclosed is a hydraulic pressure booster cylinder. In a low pressure stroke, in a state wherein a slide piston is positioned close to a third piston, as compressed air is supplied into a second pneumatic chamber, a second piston is moved toward a bore, and thereby the third piston and the slide piston are integrally moved to allow a piston rod to extend out of a cylinder case. In a high pressure stroke, when movement of the second piston is blocked by a load, the slide piston is moved toward a check valve and pushes the check valve in one direction, compressed air flows into a first pneumatic chamber and air existing in the second pneumatic chamber is discharged to the outside, and, by movement of a first piston, a trunk piston portion is moved toward the third piston through the bore while maintaining airtightness.

5 Claims, 7 Drawing Sheets

【Fig. 1】
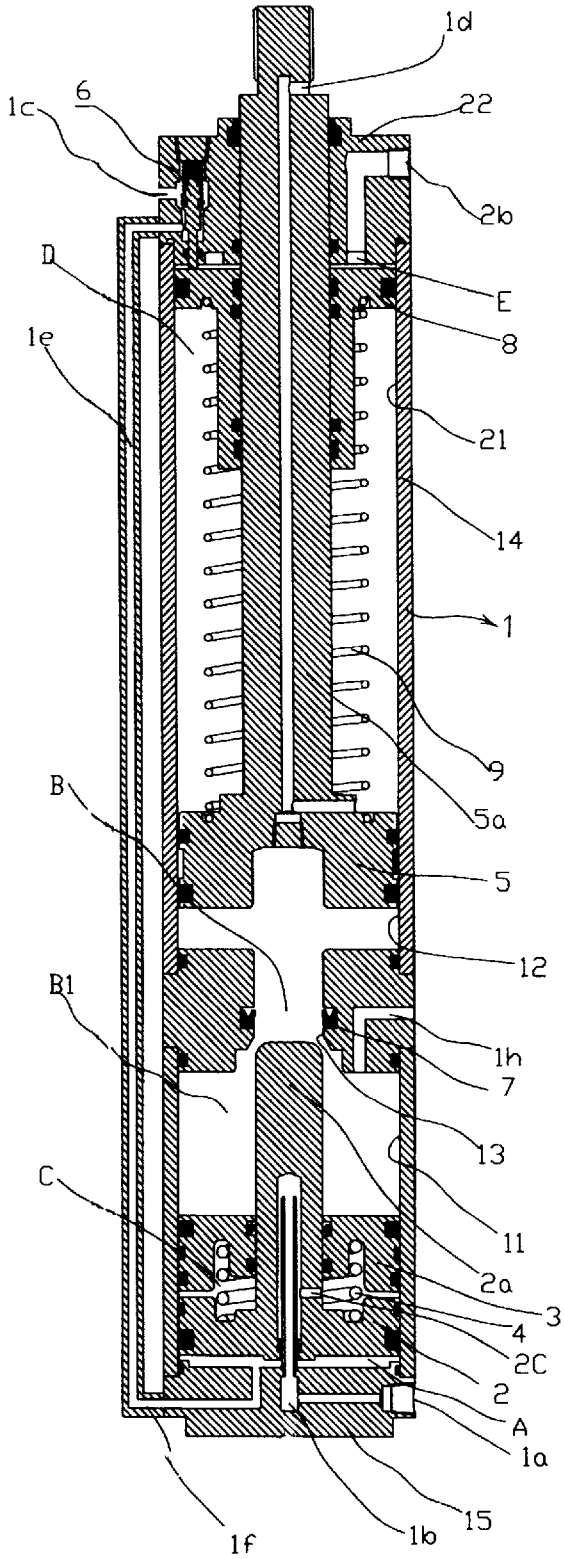

【Fig. 2】
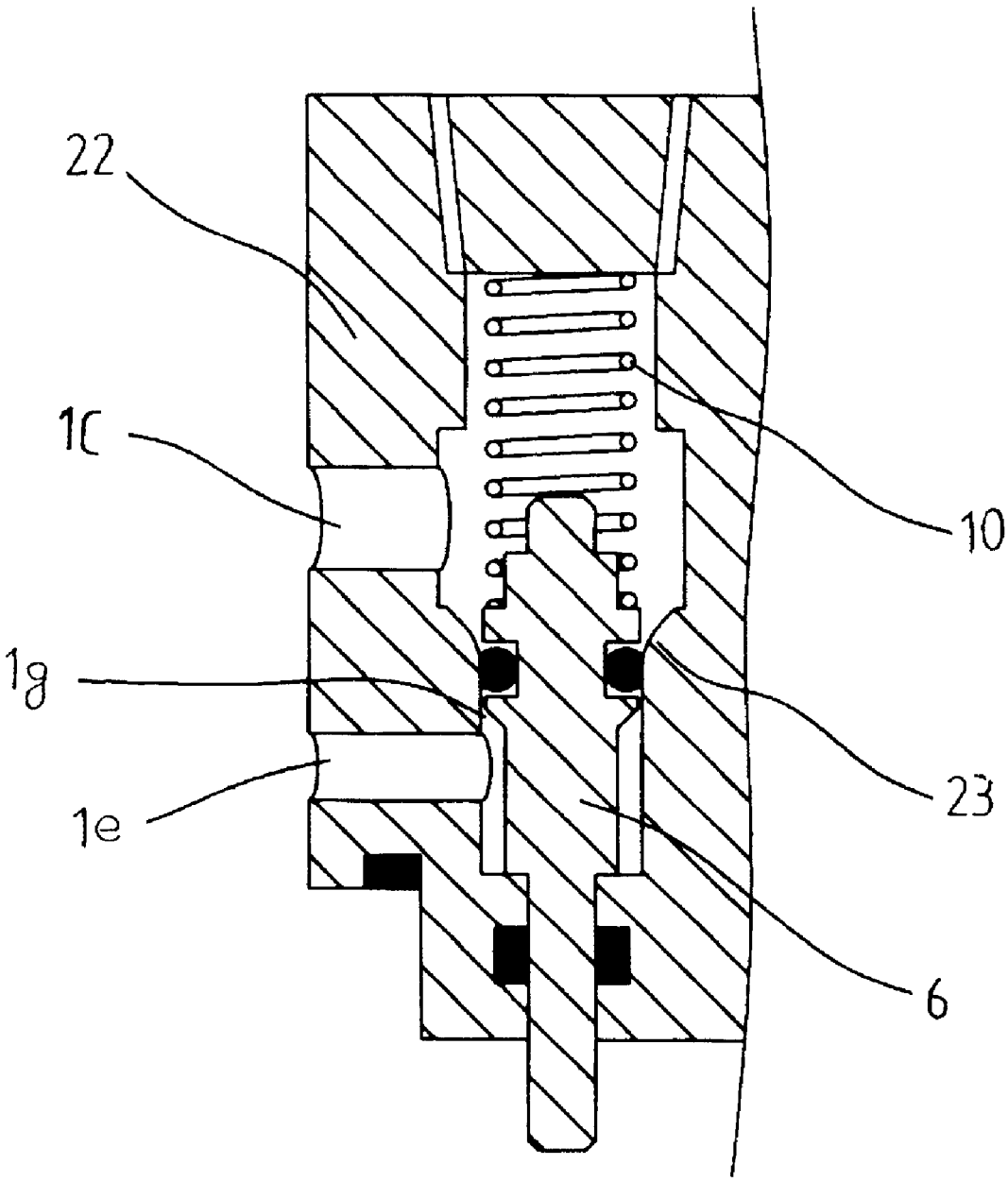

【Fig. 3】
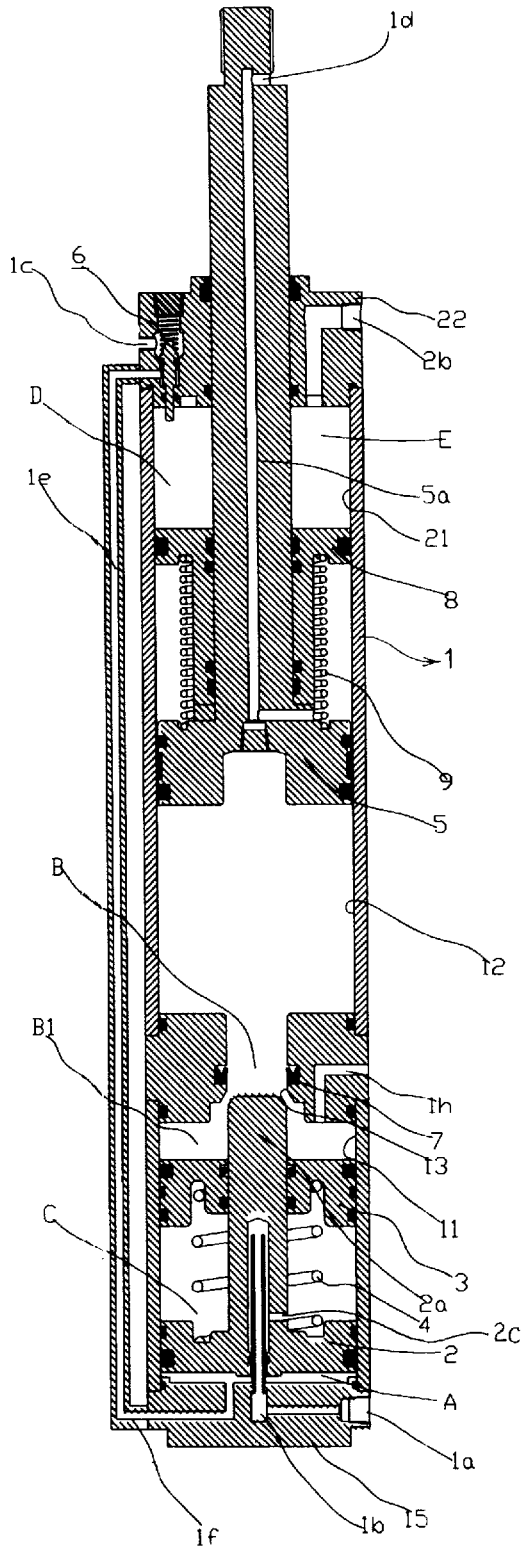

【Fig. 4】
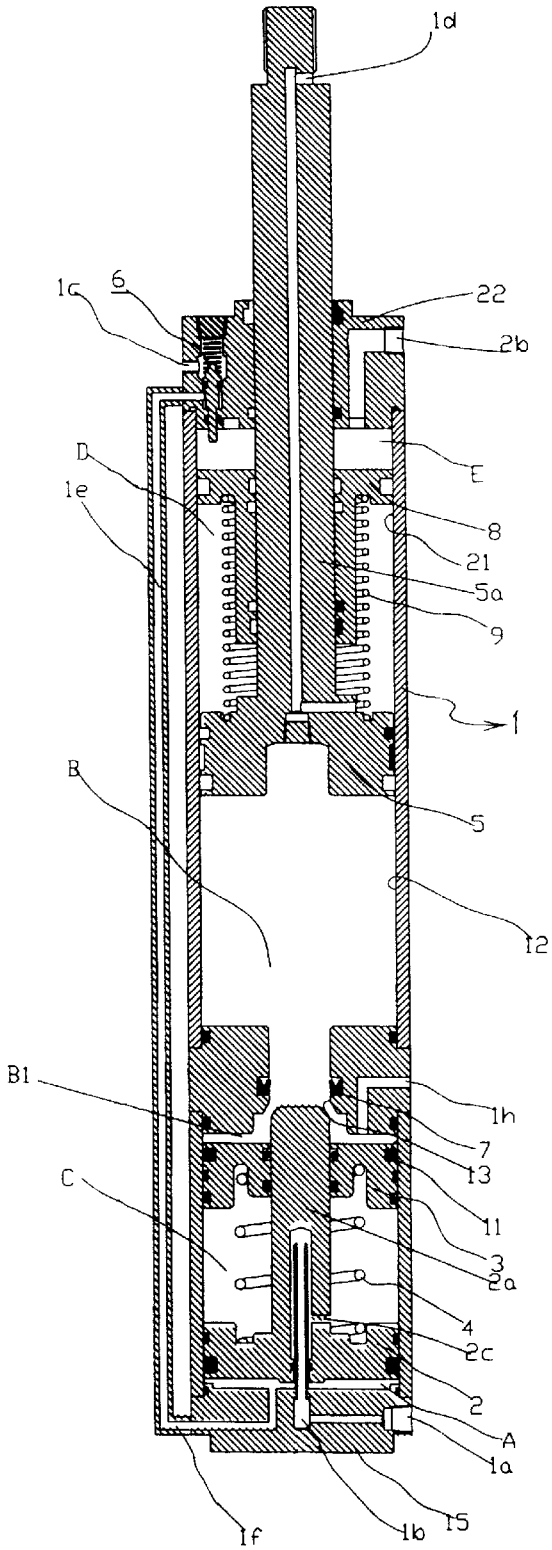

【Fig. 5】
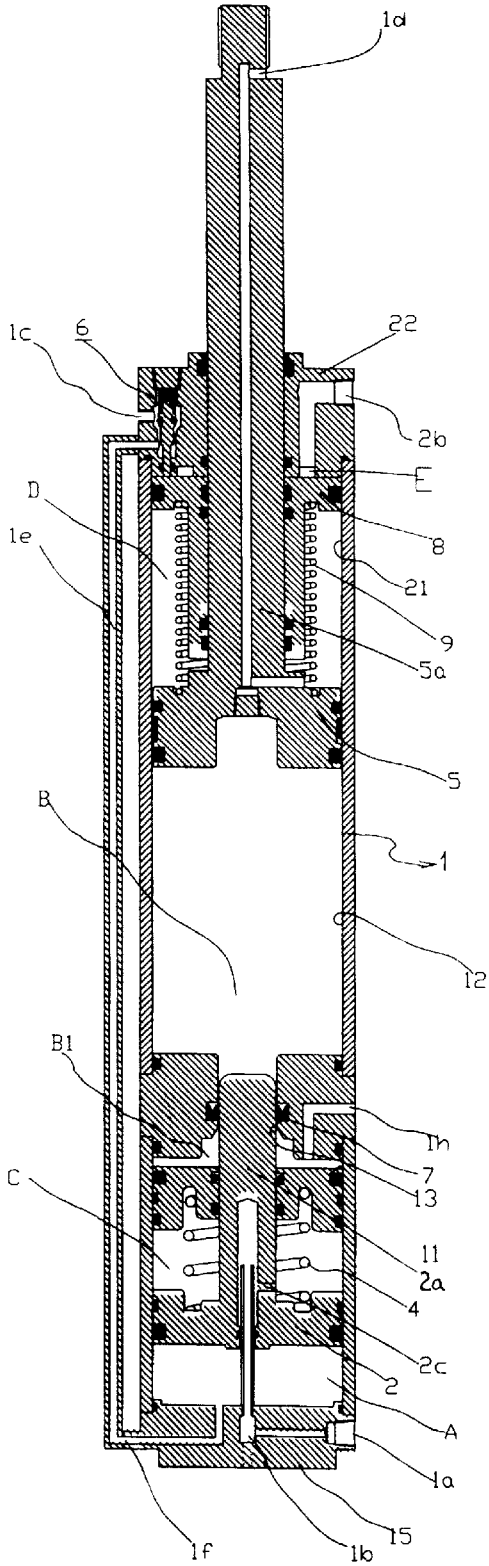

【Fig. 6】
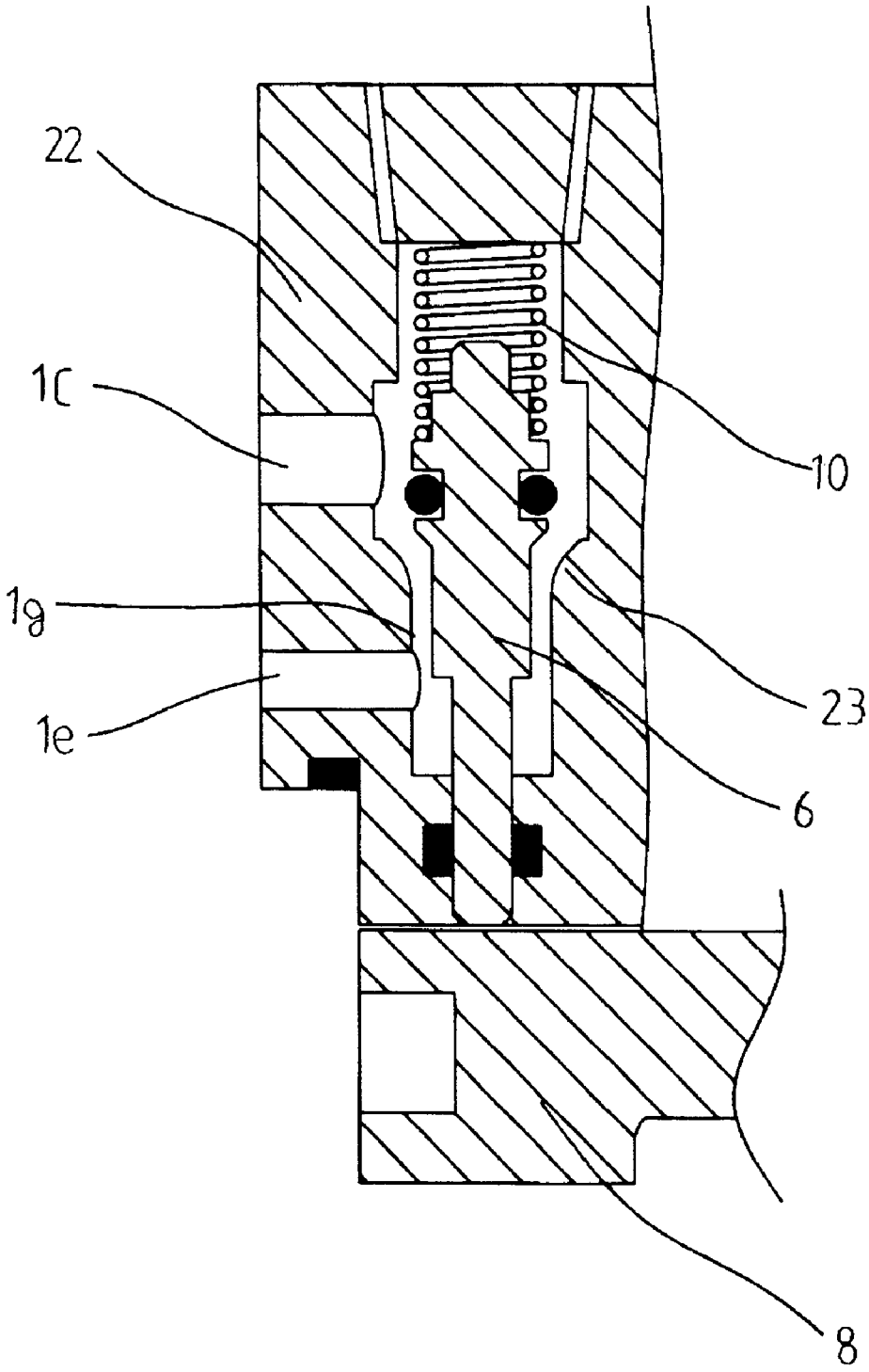

【Fig. 7】
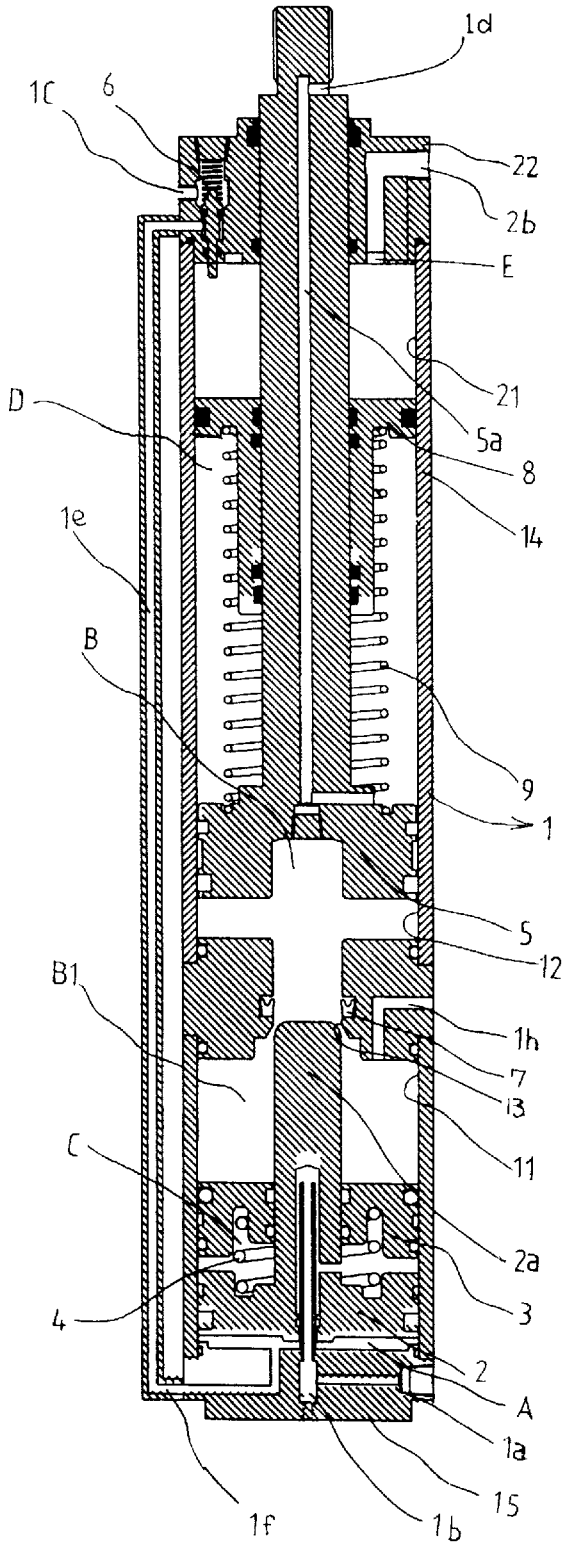

HYDRAULIC PRESSURE BOOSTER CYLINDER

This application is the national phase under 35 U.S.C. §371 of PCT International Application No. PCT/KR01/00335 which has an International filing date of Mar. 5, 2001, which designated the United States of America.

TECHNICAL FIELD

The present invention relates to a hydraulic pressure booster cylinder which maximizes advantages and functions of a pneumatic cylinder and a hydraulic cylinder, and more particularly, the present invention relates to a hydraulic pressure booster cylinder which is capable of being quickly actuated to conduct a low pressure stroke under a low load situation and being automatically converted to a high pressure stroke conducting mode under a high load situation.

BACKGROUND ART

Generally, in a pneumatic cylinder or a hydraulic cylinder which is well known in the art, when a piston is repeatedly moved so as to perform a specific work, the same pressure is applied to the piston all the way. That is to say, due to the fact that the same pressure is applied to the piston under a low load situation prior to undertaking a regular work as well as under a high load situation after undertaking the work, a moving velocity of the piston is slow at an initial operating stage, and, when the work is undertaken or a load is imposed on the piston, since the moving velocity of the piston is further slowed, working efficiency cannot but be deteriorated.

Therefore, it would be desirable for a pneumatic or hydraulic cylinder to be actuated in such a way as to conduct a low pressure stroke with a low load applied before a work is initially undertaken and at the same time a high pressure stroke with a high load applied after the work is undertaken. In this connection, the present invention is directed toward a hydraulic pressure booster which can be quickly actuated upon conducting a low pressure stroke and can generate great working force upon conducting a high pressure stroke.

DISCLOSURE OF THE INVENTION

Accordingly, the present invention has been made in an effort to solve the problems occurring in the related art, and an object of the present invention is to provide a hydraulic pressure booster cylinder which is capable of being quickly actuated to conduct a low pressure stroke under a low load situation and being automatically converted to a high pressure stroke conducting mode under a high load situation, thereby to output force of a desired level as occasion demands.

In order to achieve the above object, according to the present invention, there is provided a hydraulic pressure booster cylinder including a cylinder case possessing a first cylinder hole of a first inner diameter, a second cylinder hole of a second inner diameter equal to or less than the first inner diameter and a bore of a third inner diameter less than the second inner diameter, the bore being defined between the first cylinder hole and the second cylinder hole in a manner such that the first cylinder hole, second cylinder hole and bore are communicated one with another, a first piston reciprocatingly disposed in the first cylinder hole and having a trunk piston portion which is selectively inserted into the bore, a second piston reciprocatingly disposed in the first cylinder hole, the trunk piston portion of the first piston passing through the second piston, a first spring arranged between the first piston and the second piston to elastically support the second piston, a third piston reciprocatingly disposed in the second cylinder hole and having a piston rod which projects out of one end of the cylinder case, a slide piston reciprocatingly disposed in the second cylinder hole, the piston rod of the third piston passing through the slide piston, and a second spring arranged between the third piston and the slide piston, the hydraulic pressure booster cylinder taking first and second pneumatic chambers defined at the other end of the cylinder case and respectively connected to first and second pneumatic lines, a third pneumatic chamber defined between the third piston and the slide piston and connected to a third pneumatic line which is communicated with the outside, and a fourth pneumatic chamber defined between the slide piston and a cylinder cap which closes the one end of the cylinder case and connected to a fourth pneumatic line, characterized in that the slide piston is elastically supported by the second spring on the third piston, and a check valve which is elastically supported by a third spring, is driven by movement of the slide piston, wherein, upon conducting a low pressure stroke, when the piston rod of the third piston is retracted into the cylinder case, the slide piston is positioned close to the third piston while compressing the second spring, and when the piston of the third piston is extended out of the cylinder case, in the case of a low load situation, as compressed air is supplied into the second pneumatic chamber via the second pneumatic line, the second piston is moved toward the bore, and thereby the third piston and the slide piston are correspondingly moved to allow the piston rod of the third piston to extend out of the cylinder case, and wherein, upon conducting a high pressure stroke, when movement of the second piston is blocked by resistant force acting against the piston rod of the third piston, the slide piston is continuously moved toward the check valve by elastic force of the second spring and pushes the check valve in one direction, compressed air flows through the first pneumatic line into the first pneumatic chamber and air existing in the second pneumatic chamber is discharged to the outside, and, by movement of the first piston, the trunk piston portion of the first piston is moved toward the third piston through the bore while maintaining airtightness.

BRIEF DESCRIPTION OF THE DRAWINGS

The above objects, and other features and advantages of the present invention will become more apparent after a reading of the following detailed description when taken in conjunction with the drawings, in which:

FIG. 1 is a longitudinal cross-sectional view illustrating a hydraulic pressure booster cylinder in accordance with an embodiment of the present invention;

FIG. 2 is a partial enlarged longitudinal cross-sectional view illustrating a check valve which is used in the hydraulic pressure booster cylinder according to the present invention;

FIG. 3 is a longitudinal cross-sectional view for explaining an operational status upon conducting a low pressure stroke of the hydraulic pressure booster cylinder according to the present invention;

FIG. 4 is a longitudinal cross-sectional view for explaining an operational status of a slide piston under a high load situation of the hydraulic pressure booster cylinder according to the present invention;

FIG. 5 is a longitudinal cross-sectional view for explaining an operational status upon conducting a high pressure stroke of the hydraulic pressure booster cylinder according to the present invention;

FIG. 6 is a partial enlarged longitudinal cross-sectional view illustrating the check valve which is at a condition shown in FIG. 5; and FIG. 7 is a longitudinal cross-sectional view illustrating a state wherein the hydraulic pressure booster cylinder according to the present invention is actuated in a reverse direction.

BEST MODE FOR CARRYING OUT THE INVENTION

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a longitudinal cross-sectional view illustrating a hydraulic pressure booster cylinder in accordance with an embodiment of the present invention. The hydraulic pressure booster cylinder according to the present invention is composed of a cylinder case 1 which renders a body, and a plurality of parts which are placed in the cylinder case 1.

The cylinder case 1 possesses a first cylinder hole 11 of a first inner diameter, a second cylinder hole 12 of a second inner diameter which is equal to or less than the first inner diameter of the first cylinder hole 11, and a first bore 13 defined between the first cylinder hole 11 and the second cylinder hole 12. The first bore 13 has a third inner diameter which is less than the second inner diameter of the second cylinder hole 12. The first cylinder hole 11, second cylinder hole 12 and first bore 13 are communicated one with another. A slide piston 8 is reciprocatingly disposed in the second cylinder hole 12. Outer ends of the first and second cylinder holes 11 and 12 are closed by first and second cylinder caps 15 and 22, respectively. Pneumatic lines 1*a*, 1*b*, 1*c*, 1*d*, 1*e*, 1*f*, 1*g* and 1*h* are formed in the first and second cylinder caps 15 and 22. The plurality of parts include four pistons 2, 3, 5 and 8, two springs 4 and 9, and a check valve 6. A first piston 2 has a trunk piston portion 2*a* which can be selectively inserted into the first bore 13, and is reciprocatingly disposed in the first cylinder hole 11. A second piston 3 is also reciprocatingly disposed in the first cylinder hole 11. The trunk piston portion 2*a* of the first piston 2 passes through the second piston 3. A first spring 4 is arranged between the first piston 2 and the second piston 3 to elastically support the second piston 3. A third piston 5 has a piston rod 5*a* which projects out of the cylinder case 1, and is reciprocatingly disposed in the second cylinder hole 12. The piston rod 5*a* of the third piston 5 passes through the slide piston 8 which is reciprocatingly disposed in the second cylinder hole 12. The slide piston 8 is elastically supported on the third piston 5 by a second spring 9.

The check valve 6 is drivably embedded in the second cylinder cap 22 which closes the outer end of the second cylinder hole 12. One end of the pneumatic line 1*g* which is defined around the check valve 6 in the second cylinder cap 22, is connected with a first pneumatic chamber A via the pneumatic line 1*e*. The other end of the pneumatic line 1*g* is connected with the pneumatic line 1*c*.

A third pneumatic chamber D which is defined between the slide piston 8 and the third piston 5, is communicated with the outside via the pneumatic line 1*d* which is defined through the piston rod 5*a* of the third piston 5.

The check valve 6 is contoured in a manner such that, when the slide piston 8 is brought into contact with the check valve 6 by reaction force of the second spring 9 to push upward the check valve 6, the check valve 6 is moved upward, and by this, compressed air existing in the pneumatic line 1*c* is supplied into the first pneumatic chamber A via the pneumatic lines 1*g* and 1*e*.

FIG. 2 is a partial enlarged longitudinal cross-sectional view illustrating the check valve 6 shown in FIG. 1. As can be readily seen from FIG. 2, the check valve 6 according to the present invention is disposed in a second bore 23 which is defined in the second cylinder cap 22 and has a predetermined narrow inner diameter, and a third spring 10 is secured to the check valve 6. Normally, the check valve 6 is held inserted into the second bore 23 in such a way as to prevent compressed air existing in the pneumatic line 1*c* from flowing into the pneumatic line 1*e* and allow compressed air existing in the pneumatic line 1*e* from flowing into the pneumatic line 1*c*.

The pneumatic line 1*e* is communicated with the pneumatic line 1*f* which in turn is communicated with the first pneumatic chamber A.

As a consequence, when the slide piston 8 does not push upward the check valve 6, the check valve 6 is inserted into the second bore 23 by elastic force of the third spring 10 so as to prevent, as described above, compressed air existing in the pneumatic line 1*c* from flowing into the pneumatic line 1*e*. Due to the fact that a pressure of compressed air existing in the pneumatic line 1*e* can urge the check valve 6 upward to compress the third spring 10, it is possible for compressed air existing in the pneumatic line 1*e* to flow into the pneumatic line 1*c*.

FIG. 3 is a longitudinal cross-sectional view for explaining an operational status upon conducting a low pressure stroke of the hydraulic pressure booster cylinder according to the present invention.

As air which is compressed by an external source, is supplied into a second pneumatic chamber C via the pneumatic lines 1*a*, 1*b* and 2*c*, an internal pressure of the second pneumatic chamber C is increased.

If an internal pressure of the second pneumatic chamber C is increased in this way, as the second piston 3 is moved toward the first bore 13, hydraulic medium which is stored in a hydraulic fluid storing chamber B1, flows into a hydraulic chamber B through the first bore 13, whereby the third piston 5 is moved upward.

As a result of this, the piston rod 5*a* of the third piston 5 is extended out of the cylinder case 1.

FIG. 4 is a longitudinal cross-sectional view for explaining an operational status of the slide piston 8 under a high load situation of the hydraulic pressure booster cylinder according to the present invention. If upward movement of the piston rod 5*a* is blocked by a high load, the slide piston 8 is continuously moved upward toward the check valve 6 by elastic force of the second spring 9.

FIG. 5 show a state wherein the slide piston 8 pushes upward the check valve 6 by elastic force of the second spring 9.

At this time, as best shown in FIG. 6, the check valve 6 is cleared from the second bore 23 by the slide piston 8, the pneumatic lines 1*g* and 1*c* are communicated with each other, and at the same time, air existing in the second pneumatic chamber C is discharged to the outside.

Accordingly, as compressed air existing in the pneumatic line 1*c* flows into the first pneumatic chamber A via the pneumatic lines 1*g* and 1*f*, an internal pressure dominating the first pneumatic chamber A is increased. Thereby, the first piston 2 is moved upward, and the trunk piston portion 2*a* which is integrally formed with the first piston 2, is moved upward toward the third piston 5 through the first bore 13 while maintaining airtightness. By this, the more the trunk piston portion 2*a* of the first piston 2 projects into the hydraulic chamber B, the more a pressure of the hydraulic chamber B is increased, whereby the third piston 5 is moved upward.

Thus, the piston rod 5*a* of the third piston 5 is continuously extended out of the cylinder case 1.

At this time, air existing in the third pneumatic chamber D is discharged to the outside via the pneumatic line 1*d*.

FIG. 7 is a longitudinal cross-sectional view illustrating a state wherein the hydraulic pressure booster cylinder according to the present invention is actuated in a reverse direction.

First, if compressed air is supplied into a fourth pneumatic chamber E via the pneumatic line 2*b*, as an internal pressure of the fourth pneumatic chamber E is increased, the slide piston 8 is moved toward and comes close to the third piston 5. In succession, the slide piston 8 and the third piston 5 cooperatively compress the hydraulic chamber B. By this, as an internal pressure of the hydraulic chamber B is increased, the trunk piston portion 2*a* of the first piston 2 is moved toward the second piston 3. Thereafter, as the trunk piston portion 2*a* of the first piston 2 is cleared from the first bore 13, the first piston 2 which is integrally formed with the trunk piston portion 2*a*, and the second piston are moved together toward the first cylinder cap 15, whereby the piston rod 5*a* of the piston 5 is retracted into the cylinder case 1.

INDUSTRIAL APPLICABILITY

As a result, the hydraulic pressure booster cylinder according to the present invention provides advantages in that it can be quickly actuated under a low load situation and can automatically generate output of a high level under a high load situation.

Further, by the fact that a check valve is drivably embedded into a cylinder case, it is possible to prevent the check valve from being broken down, and a construction of the entire hydraulic pressure booster cylinder can be simplified.

What is claimed is:

1. A hydraulic pressure booster cylinder including a cylinder case possessing a first cylinder hole of a first inner diameter, a second cylinder hole of a second inner diameter equal to or less than the first inner diameter and a bore of a third inner diameter less than the second inner diameter, the bore being defined between the first cylinder hole and the second cylinder hole in a manner such that the first cylinder hole, second cylinder hole and bore are communicated one with another, a first piston reciprocatingly disposed in the first cylinder hole and having a trunk piston portion which is selectively inserted into the bore, a second piston reciprocatingly disposed in the first cylinder hole, the trunk piston portion of the first piston passing through the second piston, a first spring arranged between the first piston and the second piston to elastically support the second piston, a third piston reciprocatingly disposed in the second cylinder hole and having a piston rod which projects out of one end of the cylinder case, a slide piston reciprocatingly disposed in the second cylinder hole, the piston rod of the third piston passing through the slide piston, and a second spring arranged between the third piston and the slide piston, the hydraulic pressure booster cylinder taking first and second pneumatic chambers defined at the other end of the cylinder case and respectively connected to first and second pneumatic lines, a third pneumatic chamber defined between the third piston and the slide piston and connected to a third pneumatic line which is communicated with the outside, and a fourth pneumatic chamber defined between the slide piston and a cylinder cap which closes the one end of the cylinder case and connected to a fourth pneumatic line, characterized in that the slide piston is elastically supported by the second spring on the third piston, and a check valve which is elastically supported by a third spring, is driven by movement of the slide piston, wherein, upon conducting a low pressure stroke, when the piston rod of the third piston is retracted into the cylinder case, the slide piston is positioned close to the third piston while compressing the second spring, and when the piston of the third piston is extended out of the cylinder case, in the case of a low load situation, as compressed air is supplied into the second pneumatic chamber via the second pneumatic line, the second piston is moved toward the bore, and thereby the third piston and the slide piston are correspondingly moved to allow the piston rod of the third piston to extend out of the cylinder case, and wherein, upon conducting a high pressure stroke, when movement of the second piston is blocked by resistant force acting against the piston rod of the third piston, the slide piston is continuously moved toward the check valve by elastic force of the second spring and pushes the check valve in one direction, compressed air flows through the first pneumatic line into the first pneumatic chamber and air existing in the second pneumatic chamber is discharged to the outside, and, by movement of the first piston, the trunk piston portion of the first piston is moved toward the third piston through the bore while maintaining airtightness.

2. The hydraulic pressure booster cylinder as claimed in claim 1, characterized in that the check valve is drivably embedded into the cylinder cap, and a fifth pneumatic line which is connected to an external compressed air source and the first pneumatic line which is connected with the first pneumatic chamber, are communicated with each other by the medium of a sixth pneumatic line which is defined around the check valve, in a manner such that compressed air existing in the fifth pneumatic line can be selectively supplied into the first pneumatic chamber through the sixth pneumatic line by driving of the check valve.

3. The hydraulic pressure booster cylinder as claimed in claim 2, characterized in that, in a state wherein the slide piston which is elastically supported by the second spring on the third piston, is held close to the third piston by compressed air existing in the fourth pneumatic chamber, the second pneumatic chamber is expanded by the compressed air which is supplied through the second pneumatic line, the third piston and the slide piston are integrally moved by movement of the second piston to extend the piston rod of the third piston out of the cylinder case, and, when extension of the piston rod out of the cylinder case is blocked by a high load, the slide piston opens the check valve with the aid of elastic force of the second spring.

4. The hydraulic pressure booster cylinder as claimed in claim 3, characterized in that the first and fifth pneumatic lines are configured in a manner such that, when the slide piston does not push the check valve in the one direction, the check valve can prevent compressed air from being supplied from the fifth pneumatic line into the first pneumatic line, and, where an internal pressure dominating the first pneumatic line is high, the check valve can allow compressed air from flowing from the first pneumatic line into the fifth pneumatic line.

5. The hydraulic pressure booster cylinder as claimed in claim 1, characterized in that the third pneumatic line is defined through the piston rod of the third piston so that the third pneumatic chamber is communicated with the outside through the third pneumatic line.

* * * * *